US012629576B2

(12) United States Patent
Le Cunff et al.

(10) Patent No.: US 12,629,576 B2
(45) Date of Patent: May 19, 2026

(54) EQUIPMENT FOR PLAYING BASKETBALL

(71) Applicant: DECATHLON, Villeneuve d'Ascq (FR)

(72) Inventors: Uisant Le Cunff, Villeneuve d'Ascq (FR); Clément Dauchy, Villeneuve d'Ascq (FR); Jérôme Legache, Villeneuve d'Ascq (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 17/689,023

(22) Filed: Mar. 8, 2022

(65) Prior Publication Data

US 2022/0288476 A1 Sep. 15, 2022

(30) Foreign Application Priority Data

Mar. 9, 2021 (FR) ..... 2102297

(51) Int. Cl.
*A63B 63/08* (2006.01)
*A63B 71/02* (2006.01)

(52) U.S. Cl.
CPC ..... *A63B 63/083* (2013.01); *A63B 2071/025* (2013.01); *A63B 2071/026* (2013.01)

(58) Field of Classification Search
CPC ..... A63B 63/083; A63B 2210/50; A63B 2071/025; A63B 71/023; A63B 69/0071; A63B 63/08; A63B 63/00; A63B 2243/0037; A63B 2225/09; A63B 71/0036; A63B 63/004; A63B 2071/026
See application file for complete search history.

(56) References Cited

U.S. PATENT DOCUMENTS 2,144,148 A * 1/1939 Gross ..... A63B 63/083 473/481
2,227,310 A * 12/1940 Hoppes ..... A63B 71/0054 473/481

(Continued)

FOREIGN PATENT DOCUMENTS

CN 102485298 A * 6/2012 ..... A63B 63/083
DE 29513110 U1 * 11/1995 ..... A63B 63/083

(Continued)

OTHER PUBLICATIONS

CN 102485298 A (Year: 2012).*
DE 29513110 U1 (Year: 1995).*

*Primary Examiner* — Nicholas J. Weiss
*Assistant Examiner* — Amir A Klayman
(74) *Attorney, Agent, or Firm* — Harris Beach Murtha Cullina PLLC

(57) ABSTRACT

The invention relates to a piece of equipment for playing basketball, comprising a base and a post with an upper post section carrying a board on which a basketball hoop is mounted. The post has a lower post section which is rotatably mounted on the base, the board is mounted on the upper post section through a rotational mechanism between an angular use position and an angular storage position. The rotational mechanism has a subplate for the joining together the upper end of the upper post section. The subplate has an extension linked to the board through a friction pivot, the use position of the board is delimited by the abutment of the subplate on a member secured to the board.

13 Claims, 6 Drawing Sheets

(56) References Cited

U.S. PATENT DOCUMENTS 2,831,689 A * 4/1958 Marsh ..... A63B 63/083 248/188.5
3,018,102 A * 1/1962 Murphy ..... A63B 63/083 473/481
3,137,052 A * 6/1964 Jennings ..... E04G 17/04 403/398
3,622,155 A * 11/1971 Hirsch ..... A63B 63/083 473/481
3,841,631 A * 10/1974 Dolan ..... A63B 71/023 473/481
3,881,724 A * 5/1975 Beveridge ..... A63B 63/083 473/472
3,958,786 A * 5/1976 Mann ..... F16M 11/10 211/195
4,266,764 A * 5/1981 Collins ..... A63B 63/06 273/354
4,412,679 A * 11/1983 Mahoney ..... A63B 63/083 473/483
4,522,394 A * 6/1985 Broussard ..... A63B 71/02 473/483
4,762,319 A * 8/1988 Krumholz ..... A63B 63/08 273/400
4,934,696 A * 6/1990 Jackan ..... A63B 63/083 182/163
5,098,092 A * 3/1992 Aakre ..... A63B 63/083 473/483
5,100,132 A * 3/1992 Anderson ..... A63B 63/083 473/481
5,171,009 A * 12/1992 Filewich ..... A63B 63/083 473/433
5,316,290 A * 5/1994 Parr ..... A63B 63/083 473/483
5,390,914 A * 2/1995 Schroeder ..... A63B 63/083 473/483
5,573,238 A * 11/1996 Aaron ..... A63B 71/023 473/483
5,823,898 A * 10/1998 Wang ..... A63B 69/222 473/483
5,893,809 A * 4/1999 Coats ..... A63B 63/083 473/486
5,902,197 A * 5/1999 Davis ..... A63B 63/083 473/479
6,019,690 A * 2/2000 Parr ..... A63B 63/083 473/481
6,733,403 B2 * 5/2004 Courtright ..... A63B 69/0071 473/433
6,976,945 B1 * 12/2005 Lim ..... A63B 63/083 482/148
7,094,165 B2 * 8/2006 Pile ..... A63B 63/083 473/479
7,290,744 B2 * 11/2007 Baldasari ..... A63B 71/02 473/484
7,331,882 B1 * 2/2008 White ..... A63B 63/083 473/481
7,393,292 B2 * 7/2008 Pile ..... A63B 63/083 473/479
7,407,453 B2 * 8/2008 Shannon ..... A63B 63/083 473/483
9,333,406 B1 * 5/2016 Weeder ..... A63B 63/083
10,004,963 B2 * 6/2018 Crosby ..... A63B 63/083
11,654,318 B1 * 5/2023 Lynch ..... A63B 63/083 473/465
12,134,016 B2 * 11/2024 Hall ..... A63B 63/083
2004/0171441 A1 * 9/2004 Pile ..... A63B 63/083 473/479
2005/0037875 A1 * 2/2005 Snider ..... A63B 63/008 473/477
2005/0085320 A1 * 4/2005 Joseph ..... A63B 63/083 473/433
2006/0138809 A1 * 6/2006 Joseph ..... A63B 69/0071 297/129
2006/0276273 A1 * 12/2006 Perry ..... A63B 63/083 473/481
2009/0230266 A1 * 9/2009 Hillstrom ..... F16M 13/022 248/219.4
2011/0105250 A1 * 5/2011 Tien ..... A63B 63/083 473/433
2012/0184401 A1 * 7/2012 Shepherd ..... A63B 63/083 473/481
2012/0252605 A1 * 10/2012 Monroy ..... A63B 63/083 473/469
2012/0252607 A1 * 10/2012 Shepherd ..... A47B 83/024 473/483
2017/0136327 A1 * 5/2017 Nguyen ..... A63B 63/083
2018/0093150 A1 * 4/2018 Pratt ..... A63B 71/0669
2019/0314676 A1 * 10/2019 Wilson ..... A63B 21/00058
2020/0179785 A1 * 6/2020 Cotton ..... A63B 71/0036

FOREIGN PATENT DOCUMENTS

FR 3022795 A1 1/2016
FR 3022796 A1 1/2016

* cited by examiner

[Fig.1]
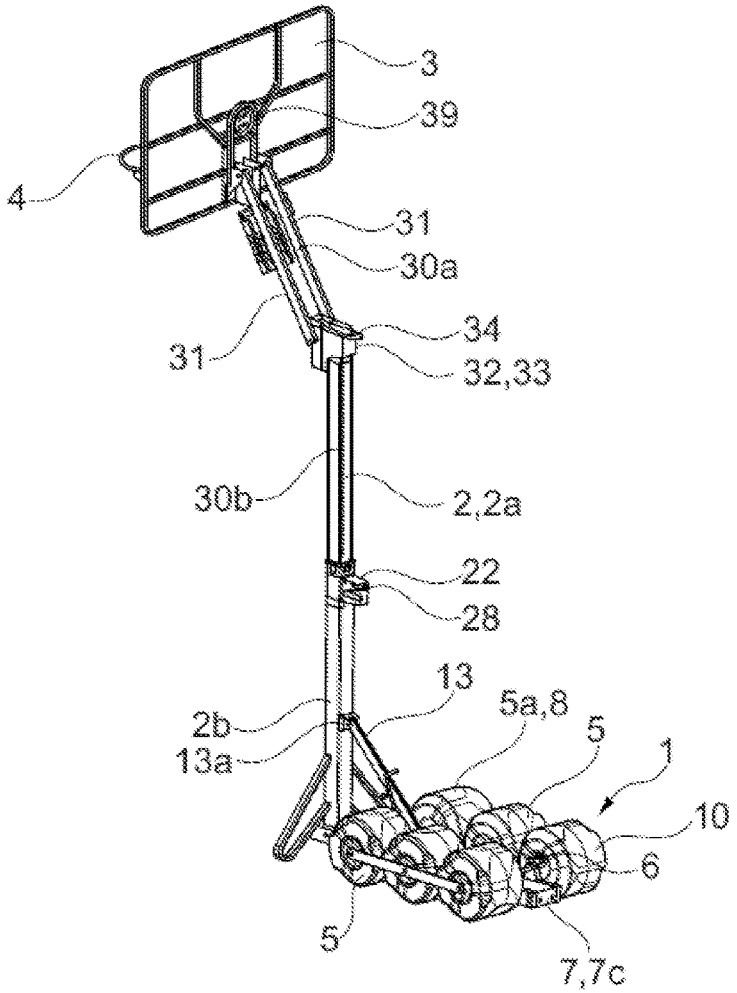
[Fig.1a]
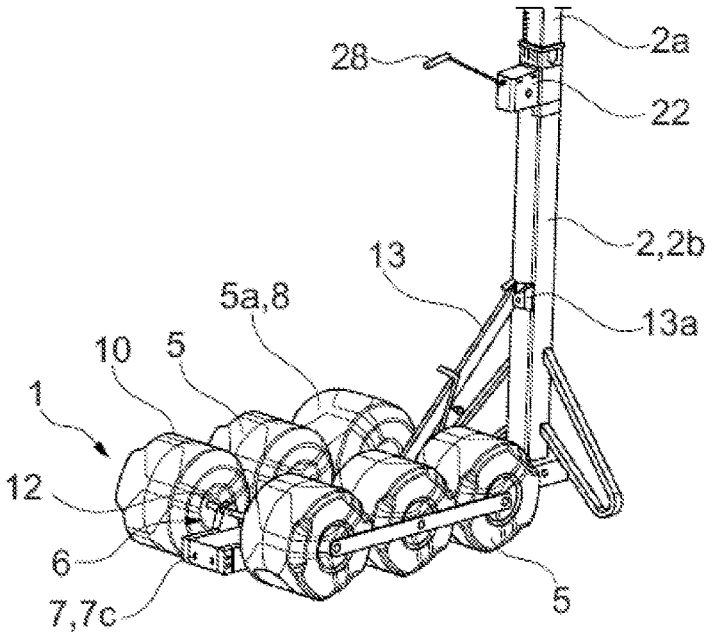

[Fig.2]
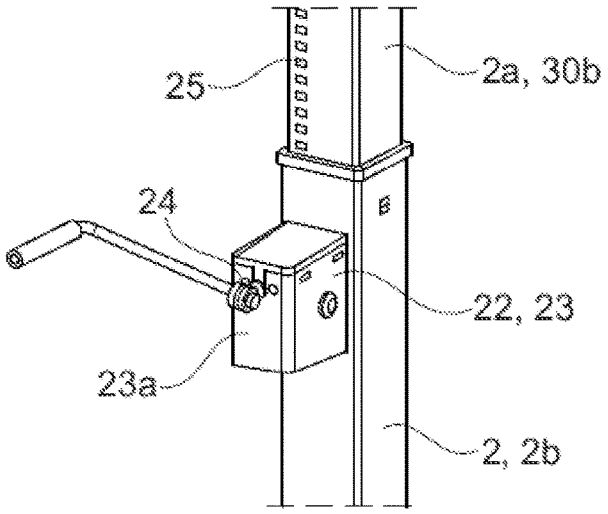
[Fig.2a]
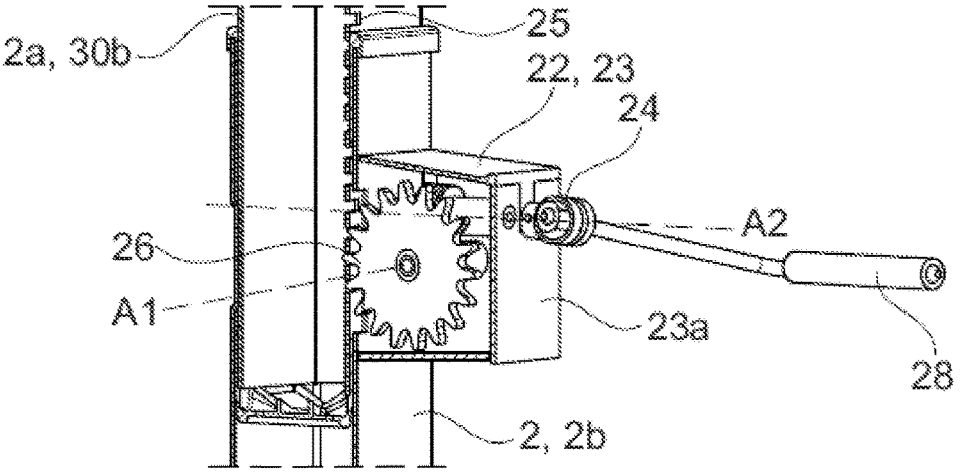
[Fig.2b]
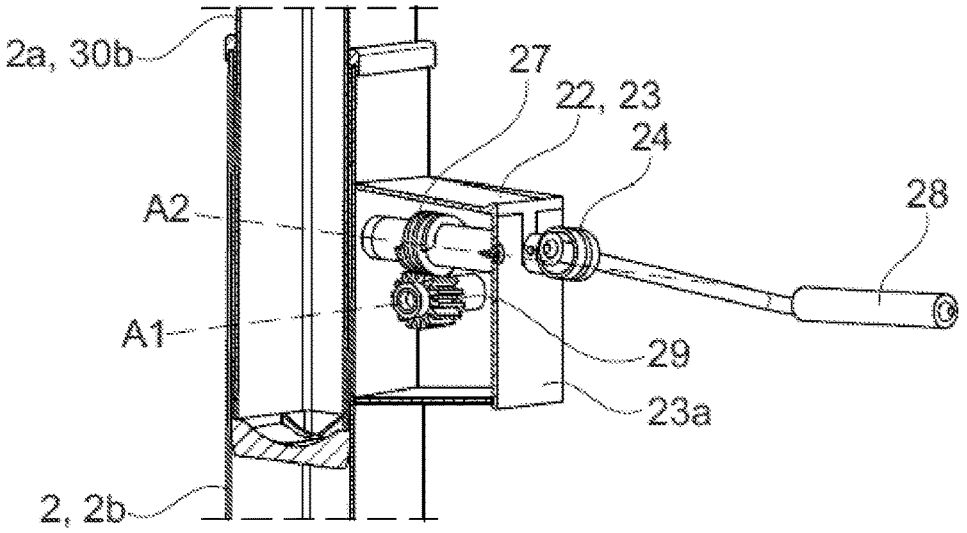

[Fig.3a]
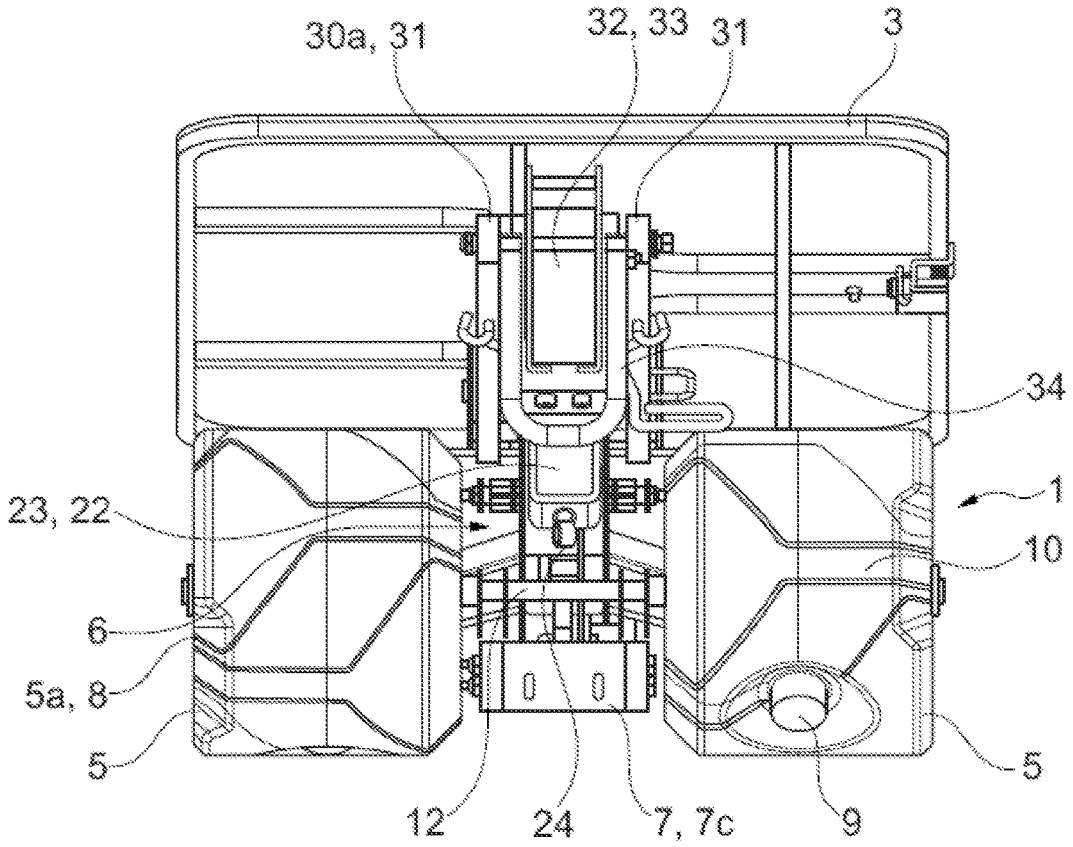
[Fig.3b]
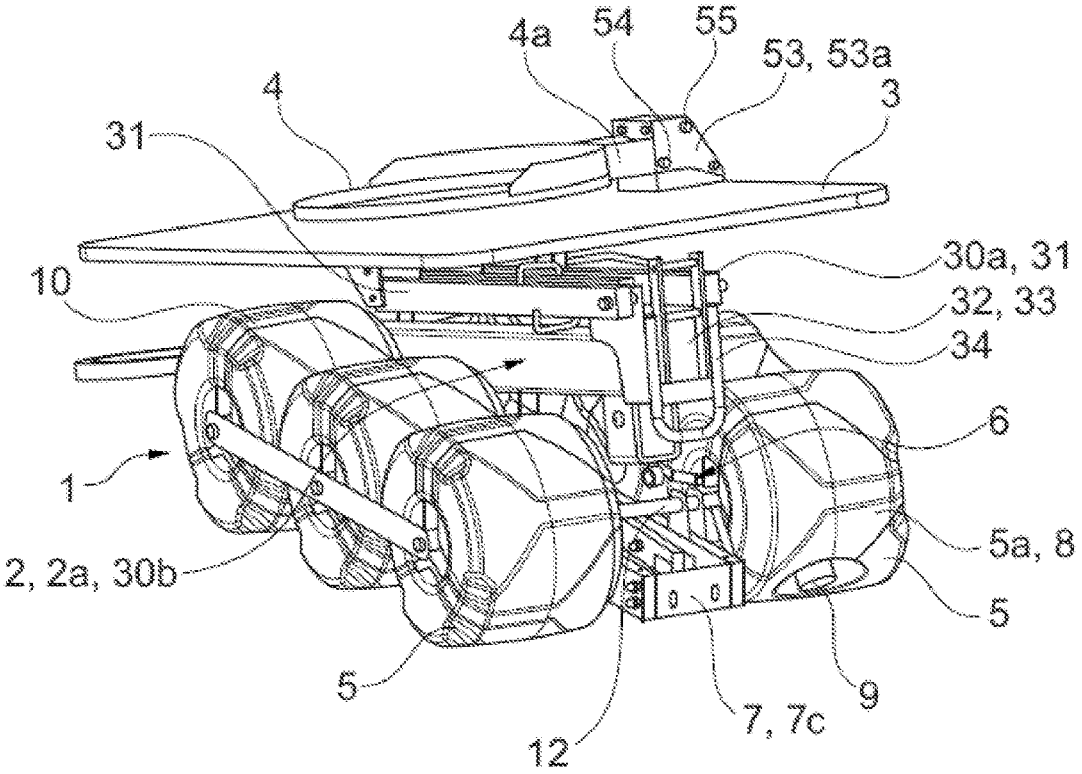

[Fig.3c]
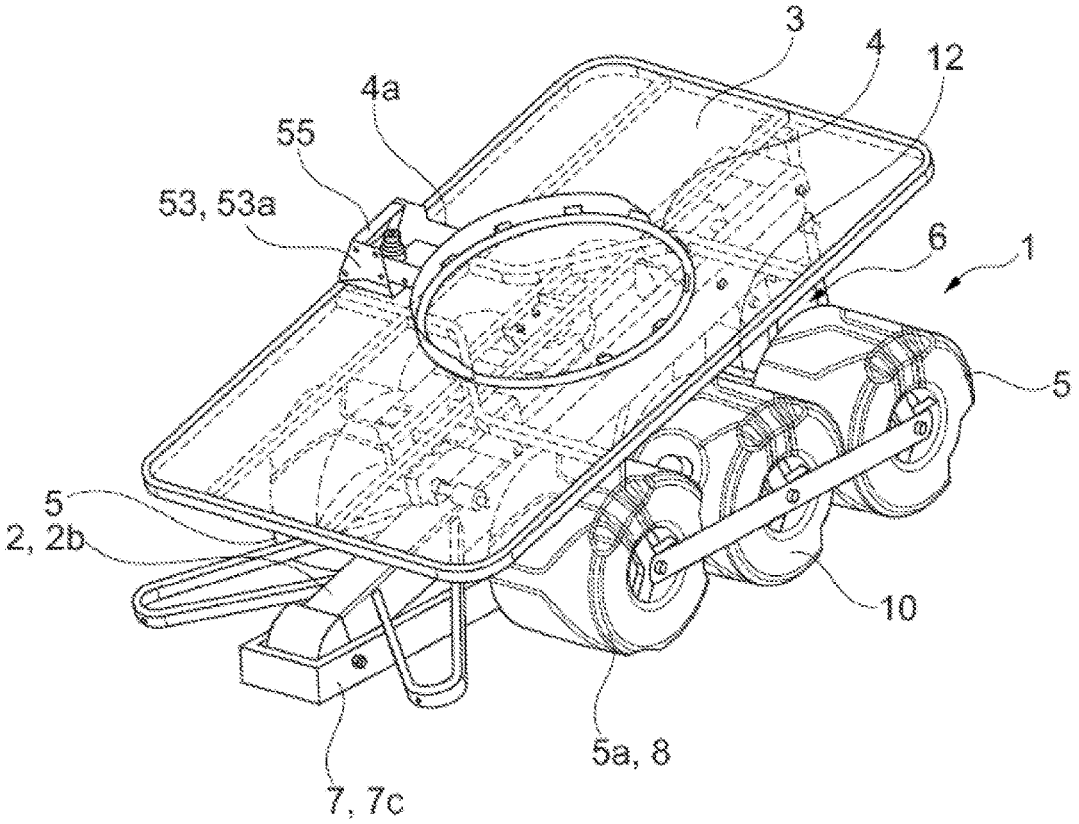
[Fig.4a]
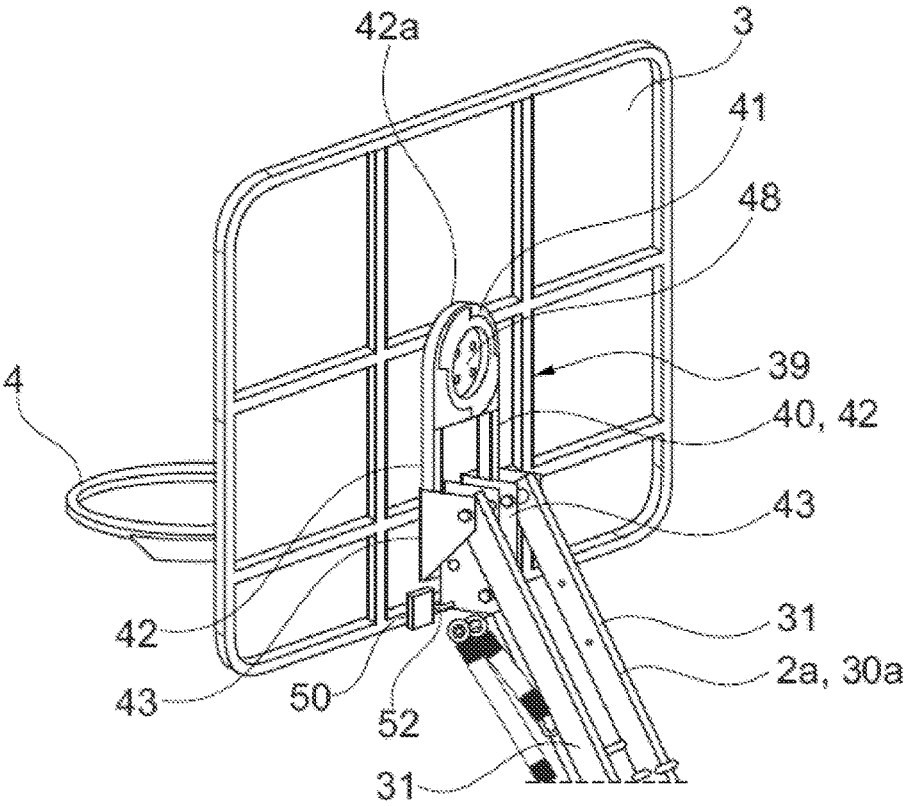

[Fig.4b]
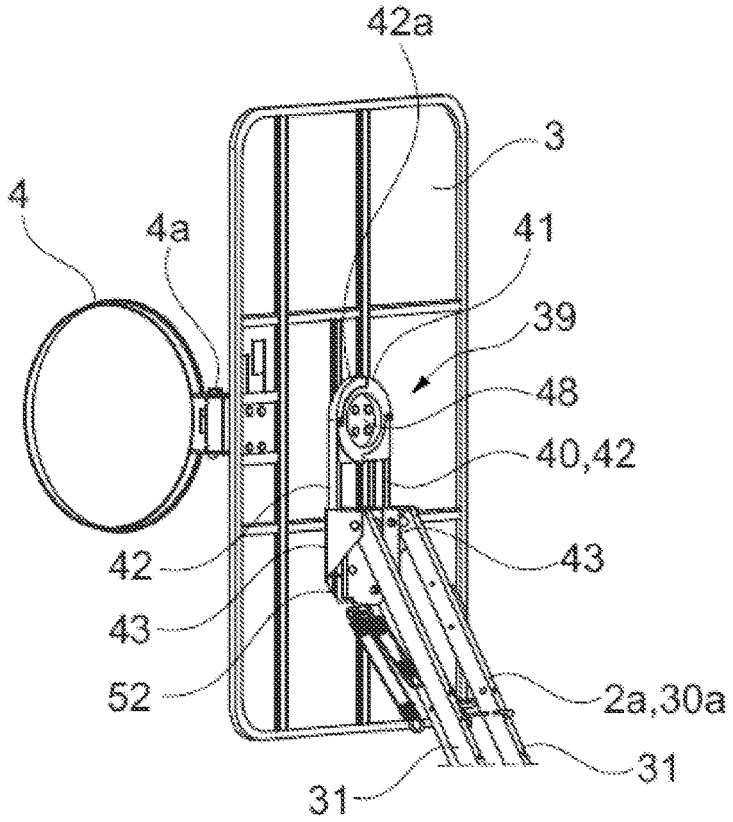
[Fig.4c]
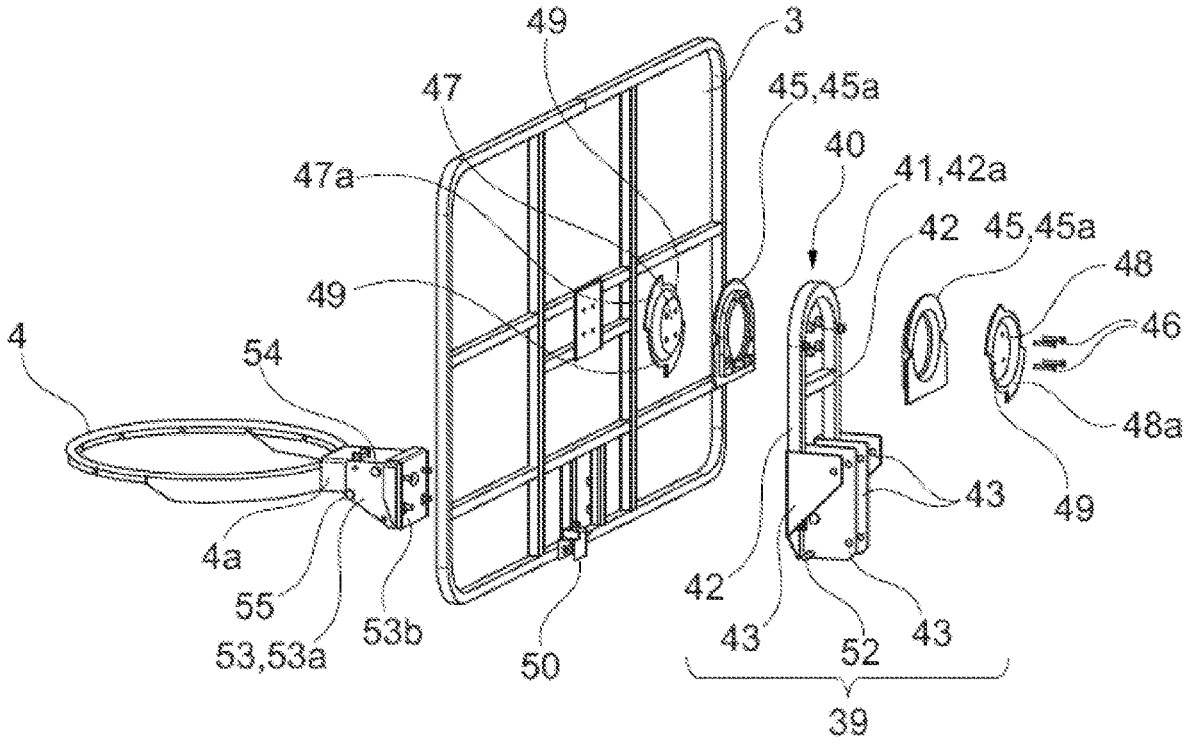

[Fig.5]
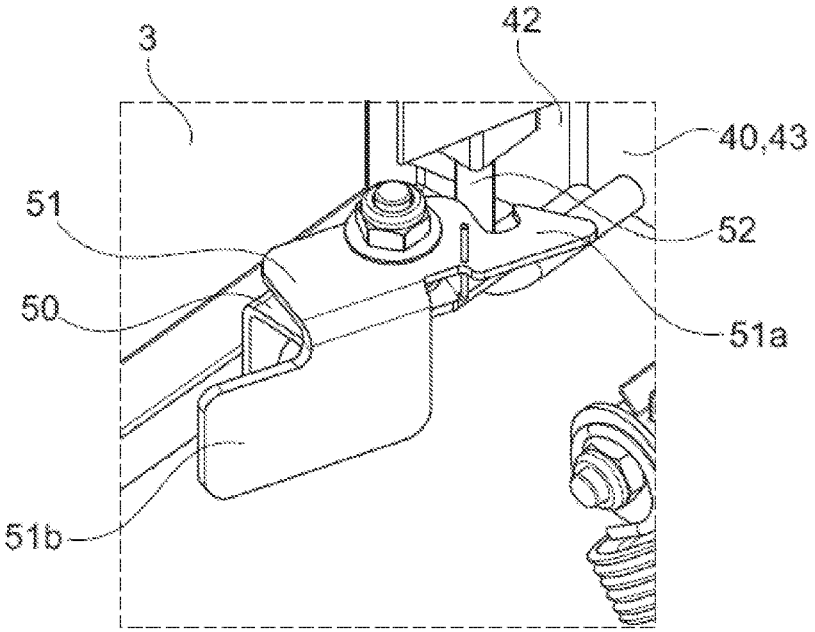
[Fig.6]
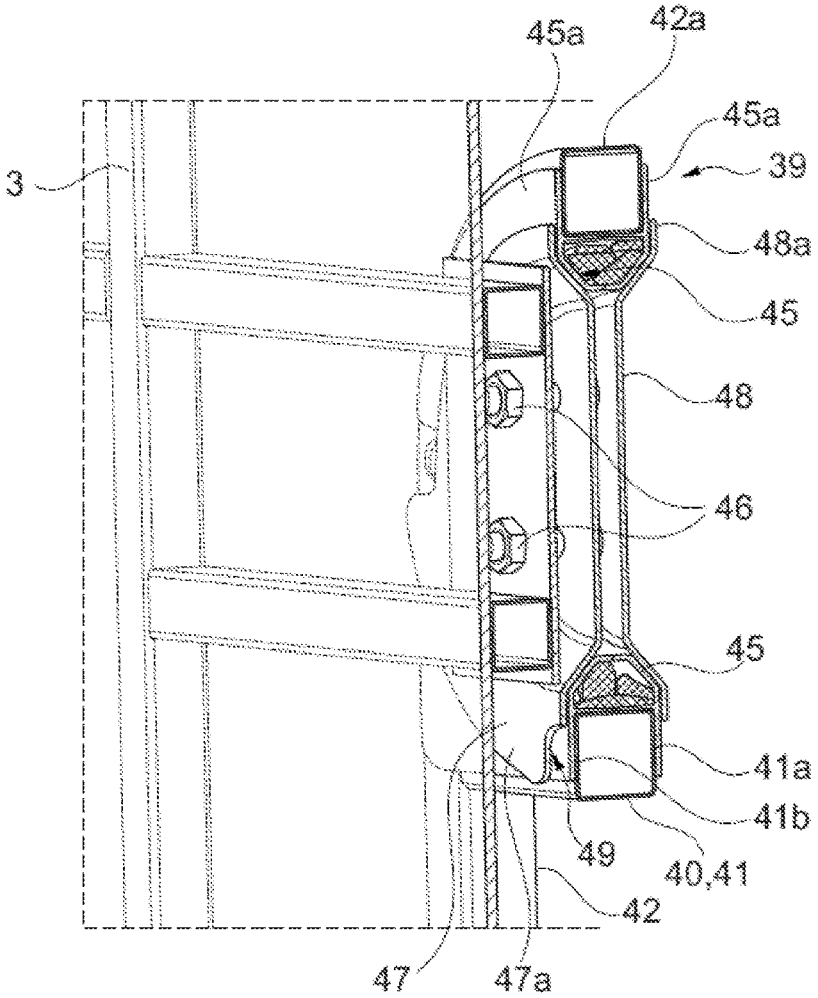

EQUIPMENT FOR PLAYING BASKETBALL

CROSS-REFERENCE TO RELATED APPLICATION

This application claims the priority of French patent application number 2102297, filed on Mar. 9, 2021, the entire contents of which are incorporated herein by reference.

TECHNICAL FIELD

The invention relates to a piece of equipment for playing basketball, comprising a base intended to be disposed bearing on the ground, as well as a post which has an upper section carrying a board on which a basketball hoop is mounted.

Such equipment that could be folded in order to facilitate the set-up and the storage thereof are known, in particular while limiting the need for tools and/or the time required for such operations, which actually might turn out to be dissuasive for use of said equipment as well as for storage thereof.

The documents FR-3 022 795 and FR-3 022 796 describe an equipment for playing basketball, wherein the base is equipped with two rows of wheels forming a housing therebetween, and whose post has a lower section which is rotatably mounted on said base so as to be able to dispose said post reversibly between a stowed storage configuration, wherein at least the lower section is disposed in the housing, and an upright use configuration.

In the storage configuration, the board is disposed above the base, according to its use angular position, which might pose a problem of bulk when the board has a longitudinal dimension that is larger than the frontal dimension of the base.

SUMMARY

The invention aims to improve the prior art by providing equipment for playing basketball wherein the board carrying the hoop could be disposed in a position allowing reducing the bulk of said equipment in its storage configuration, and that being so in a simple and intuitive manner in particular without the need for using tools.

To this end, the invention provides equipment for playing basketball, comprising a base intended to be disposed bearing on the ground and a post having an upper section carrying a board on which a basketball hoop is mounted, said post having a lower section which is rotatably mounted on said base so as to be able to dispose said post reversibly between a stowed storage configuration against the base and an upright use configuration, the board being mounted on the upper section through a rotational mechanism between an angular use position and an angular storage position, said mechanism comprising a subplate for joining together the upper end of the upper section, said subplate comprising an extension linked to the board through a friction pivot, the use position of said board being delimited by the abutment of said subplate on a member secured to the board.

BRIEF DESCRIPTION OF THE DRAWINGS

Other particularities and advantages of the invention will appear in the following description, made with reference to the appended figures, wherein:

FIG. 1 represents a perspective rear view of a piece of equipment according to a first embodiment of the invention in the use configuration, FIG. 1*a* representing a perspective rear view of the lower section of the post and the base of this same equipment;

FIG. 2 is an enlarged perspective rear view of the post of the equipment of FIGS. 1, 1*a*, centred on the system for actuating the movement of the upper section, FIG. 2*a* and FIG. 2*b* being sections of the actuation system of FIG. 2 according to two different sagittal planes;

FIG. 3*a*, FIG. 3*b* and FIG. 3*c* represent the equipment of FIGS. 1, 1*a*, 2, 2*a* and 2*b* in the storage configuration, respectively in rear view (FIG. 3*a*) and in perspective according to two different orientations (FIGS. 3*b*, 3*c*);

FIG. 4*a*, FIG. 4*b* and FIG. 4*c* represent a perspective rear view of mounting of the board on the upper section of the post in the equipment of FIGS. 1 to 4*c*, respectively in the use position (FIG. 4*a*), in the storage position (FIG. 4*b*) and in an exploded view (FIG. 4*c*);

FIG. 5 is an enlargement of FIG. 4*a* centred on the stop member defining the use position of the board;

FIG. 6 is a partial sectional view according to a sagittal plane of the mechanism for mounting the board on the upper section of the post in the equipment of FIGS. 1 to 5.

DETAILED DESCRIPTION

Referring to these figures, an equipment for playing basketball is described hereinbelow.

The equipment comprises a base 1 intended to be disposed bearing on the ground, as well as a post 2 having an upper section 2*a* carrying a board 3 on which a basketball hoop 4 is mounted.

The post 2 has a lower section 2*b* which is rotatably mounted on the base 1 to be able dispose said post reversibly between a stowed storage configuration and an upright use configuration.

The base 1 is equipped with two lateral structures 5 which form a housing 6 therebetween such that, in the storage configuration, at least the lower section 2*b* of the post 2 is disposed in said housing. In the represented embodiment, the base 1 comprises a frame 7 on which the lower section 2*b* is rotatably mounted, the lateral structures 5 being carried by said frame forming a U-like shaped housing 6 therebetween.

The two lateral structures 5 form a counterweight to the post 2 in the upright configuration for use of the equipment, in order to avoid a tilting of said equipment, and thus guarantee the safety of its users.

At least one lateral structure 5 may be arranged so as to be able to be filled with a ballast matter, for example water or sand. In the represented embodiment, each lateral structure 5 has three modules 5*a* aligned according to a sagittal direction, each of said modules comprising a tank 8 on which an opening 9 is disposed to enable filling thereof with such a ballast matter.

For a proper distribution of the weight, the lateral structures 5 have identical modules 5*a* which are symmetrically distributed with respect to the modules 5*a* of the other lateral structure 5, on either side of a sagittal midplane containing the post 2.

The base 1 is further equipped with wheels 10 to enable the movement of the equipment, in particular in its storage configuration.

In the represented embodiment, the base 1 is equipped with two rows of wheels 10 each forming a lateral structure 5 between which is formed the housing 6 for receiving the lower section 2*b* in the stowed configuration.

In particular, each of the wheels 10 forms a ballast module 5*a* for the corresponding lateral structure 5, and has, to this end, a cylindrical tank 8 on the periphery of which an opening 9 is disposed to enable filling thereof with a ballast matter, the axis of revolution of said tank extending horizontally and perpendicularly to the sagittal plane of the frame 7, in order to be able to move the base 1 by making said tanks roll on their periphery.

In FIGS. 1, 1*a* and 3*a* to 3*c*, the frame 7 comprises a central beam 7*c* on either side of which the wheels 10 are mounted. In particular, each of the wheels 10 comprises a hub 12 secured to the central beam 7*c*, said hubs being arranged so as to enable the wheels 10 to rotate independently of each other.

As regards mounting of the lower section 2*b*, the central beam 7*c* of the frame 7 has a front portion on which said lower section is rotatably mounted. Thus, to dispose the equipment in the use configuration, the user first moves the lower section 2*b* from the stowed configuration to the upright configuration by making it pivot relative to the front portion of the beam 7*c*.

To facilitate its arrangement in the use configuration, the equipment comprises a connecting arm 13 which has a front end 13*a* hinged on the lower section 2*b*, as well as a rear end hinged on the base 1, in particular by being disposed in the housing 6 for receiving said lower section.

In particular, at least one amongst the front 13*a* and rear ends of the connecting arm 13 is slidably mounted on the lower section 2*b* and the base 1 respectively.

In the represented embodiment, the connecting arm 13 comprises a front end 13*a* rotatably mounted on a rear face of the lower section 2*b* and a rear end rotatably and slidably mounted on a horizontal rail formed on the central beam 7*c*.

The lower section 2*b* is equipped with at least one foot 18 which is disposed laterally, in order to stabilise the post 2 in the upright configuration, in particular to prevent tilting thereof on the sides, in combination with the base 1 which forms a counterweight to avoid tilting thereof forwards or rearwards.

In the figures, the lower section 2*b* comprises two feet 18 disposed on either side of its lower end. The feet 18 are fastened on the lower section 2*b* so as to bear on the ground when the post 2 is in the upright configuration, which also allows preventing the base 1 from rolling when the equipment is in the use configuration.

The upper section 2*a* is slidably mounted on the lower section 2*b*, the equipment comprising a system 22 for actuating this movement over a stroke comprised between a storage retracted position and at least one projecting position corresponding to a height of use.

Referring to FIGS. 2, 2*a* and 2*b*, the actuation system 22 comprises a case 23 fastened on a rear wall of the lower section 2*b* and a mechanism for moving an upper section 2*a* which is housed in said case, said mechanism comprising a handling socket 24 which projects from said case.

In particular, the handling socket 24 is disposed on a rear wall 23*a* of the case 23, and the housing 6 of the base 1 is arranged so as to receive the lower section 2*b* in the stowed configuration while preventing access to said handling socket, as represented in FIG. 3*a*.

Thus, the risk of an inadvertent deployment of the upper section 2*a* when the equipment is in the storage configuration is optimally limited, and that being so without having to make considerable changes in the geometry of the housing 6, and therefore of the base 1.

In the represented embodiments, the upper section 2*a* is slidably mounted in the lower section 2*b*. In particular, as represented in FIGS. 2 and 2*a*, the actuation system 22 comprises a vertical row of orifices 25 formed on the rear face of the upper section 2*a* and a mechanism comprising a gear wheel 26 which is rotatably actuated by a worm screw 27, said wheel being arranged so as to successively fit into the orifices 25 for sliding of the upper section 2*a* in the lower section 2*b*.

The gear wheel 26 is rotatably mounted in the case 23 according to a frontal axis A1, and the screw 27 is rotatably mounted in the case 23 according to a sagittal axis A2. The screw 27 has a rear end which projects from the rear wall 23*a* of the case 23 and on which a metallic loop 24 is fastened forming a handling socket for manipulating the mechanism.

Advantageously, a crank handle 28 may be reversibly associated on the handling loop 24 of the screw 27, so as to be removed from said loop when the mechanism is not actuated. This arrangement allows not only limiting the bulk of the system 22 when it is arranged in the housing 6, but also limiting the risk of inadvertent actuation of the mechanism when the equipment is in the use configuration, in order to guarantee the safety of the users.

The actuation mechanism comprises two gear wheels 26, 29 with a different diameter which are secured in rotation. Referring to the sectional FIGS. 2*a* and 2*b*, the wheel with a large diameter 26 is fitted into the orifices 25 and the wheel with a small diameter 29 is actuated by the worm screw 27.

The worm screw 27 may be arranged so as to require a handling of the socket 24 to actuate the upper section 2*a* in either one of its directions of movement. Thus, in particular, a rotation of the wheels 26, 29 in the direction of retraction of the upper section 2*a* when the screw 27 is not actuated is prevented, which allows ensuring holding of said upper section at the selected height, in order to guarantee the safety of the users by preventing an inadvertent retraction in the lower section 2*b* during the use of the equipment.

To limit the bulk of the equipment in the storage configuration, the upper section 2*a* of the post 2 comprises an upper segment 30*a* carrying the board 3 and a lower segment 30*b* slidably mounted on the lower section 2*b*, said upper segment being movably mounted relative to said lower segment between a use configuration, in which said upper segment is deployed relative to said lower segment, and a storage configuration, in which said upper segment forms a compact arrangement with said lower segment.

Thus, once the lower section 2*b* is in the upright position, the user can dispose the equipment in the use configuration by successively deploying the lower segment 30*b* out of said lower section, by actuation of the system 22 by means of the crank handle 28, and then the upper segment 30*a* relative to said lower segment.

In the represented embodiment, the upper segment 30*a* is rotatably mounted on the lower segment 30*b* between an angular upright use configuration and an angular folded storage configuration against the lower segment 30*b*.

In particular, the upper segment 30*a* comprises at least one pair of parallel bars 31 each having a rear end rotatably mounted on the upper end of the lower segment 30*b*, as well as a front end on which the board 3 is rotatably mounted according to a frontal axis. Thus, the upper segment 30*a* forms a deformable four-bar linkage which enables the user to angularly deploy said upper segment and lay out the board 3 in one single gesture.

The equipment may further comprise a system 32 for locking the upper segment 30*a* in the upright configuration, in order to avoid any inadvertent tilting of said upper segment in the folded configuration, in particular during the use of said equipment, and thus ensure the safety of the users.

In FIG. 1, the locking system 32 comprises a case 33 which is mounted on the upper end of the lower segment 30*b*, and on each lateral face of which the rear end of an upper parallel bar 31 is rotatably mounted, said case enclosing a locking mechanism which could be reversibly actuated by means of a toggle lever 34 mounted at the upper portion of said case.

The board 3 is movable relative to the upper segment 30*a* between a use position and a storage position, which allows limiting the bulk of the board 3 in the storage configuration of the equipment.

In the represented embodiment, the board 3 has a quadrilateral, in particular rectangular, geometry, which, when in the storage position, is turned by 90° with respect to its use position on the upper segment 30*a*. In particular, the board 3 has longitudinal and lateral dimensions which substantially correspond respectively to the sagittal and frontal dimensions of the base 1. Thus, to the extent that the base 1 has a sagittal dimension that is larger than its frontal dimension to be able to ensure the stability of the equipment with regards to a front-rear tilting, it is possible to store a rectangular board that is satisfactory for the sports practice, within the bulk of said base.

The board 3 is rotatably mounted on the upper segment 30*a* between an angular use position (FIGS. 1, 4*a*, 4*c*) and an angular storage position (FIGS. 3*a* to 3*c* and FIG. 4*b*), in particular through a rotational mechanism 39 between these two positions.

Referring to FIGS. 4*a* to 6, the rotational mechanism 39 comprises a subplate 40 for joining together the upper end of the upper segment 30*a*, said subplate comprising an extension 41 linked to the board through a friction pivot. As represented in FIG. 4*a*, the extension 41 is disposed above the upper segment 30*a* when the board 3 is in the use position.

The extension 41 of the subplate 40 comprises a U-like shaped structure whose two branches 42 carry means for joining together the upper end of the upper section, the base 42*a* of said U-like shape being engaged into the pivot connection.

In particular, each branch 42 has a pair of vertical lateral plates 43 between which the upper end of respectively one bar 31 is rotatably mounted.

The extension 41 is clamped against the board 3 with at least one friction insert 45 interposed therebetween, the equipment further comprising a clamping adjustment means 46 in order to optimise the friction torque of the rotation.

For this purpose, the rotational mechanism 39 comprises a rear cup 47 fastened on the rear face of the board 3 and a front cup 48, the extension 41 being disposed between the cups 47, 48 which are equipped with means 46 for clamping said extension therebetween, at least one cup 47, 48 housing a friction insert 45.

In FIGS. 4*a*, 4*b*, 4*c* and 14, each cup 47, 48 houses a friction insert 45, the extension 41 being clamped between said cups and fastened at the rear of the board 3 by means of four screws 46.

Each insert 45 is immobilised in rotation between the cups 47, 48, and comprises a friction bushing 45*a* which is clamped respectively on a rear 41*b* and a front 41*a* face of the extension 41 through a clamping bushing 47*a*, 48*a* formed on the adjacent cup 47, 48.

The extension 41 has a square section, as represented in particular in FIG. 6, or rectangular, a friction bushing 45*a* being clamped respectively against a front face 41*a* and a rear face 41*b* of said section.

Each clamping bushing 47*a*, 48*a* has indentations 49, and in particular two indentations 49 with identical angular dimensions which are diametrically opposite along said bushing.

After having disposed the lower section 2*b* in the upright configuration, the user can dispose the board 3 in the use position by making it pivot by means of the rotational mechanism 39. Afterwards, the user can make the upper segment 30*a* pivot to dispose it in the upright configuration, and then erect the lower segment 30*b* out of the lower section 2*b* by actuation of its system 22, up to the desired height of the board 3.

The use position of the board 3 is delimited by the abutment of the subplate 40 on a member 50 secured to said board. This arrangement allows disposing the board selectively in its storage and use positions through a simple and intuitive gesture, and that being so without the need for using tools.

Advantageously, the stop member 50 of the board 3 comprises a means 51 for locking the use position, which allows safeguarding said position, in particular by avoiding any inadvertent rotation of said board during the use of the equipment.

Referring to FIG. 5, the locking means is a latch 51 which reversibly fits on an axis 52 secured to the subplate 40. In particular, the axis 52 is fastened on the lower end of one of the branches 43 of the U-like shaped extension 41, and the latch 51 comprises a hook 51*a* which fits on said axis in the locking position, as well as a leg 51*b* that the user could manually grasp to make the latch 51 pivot and clear the hook 51*a* of said axis, when he wishes to make the board 3 pivot towards its storage position.

As represented in FIG. 4*c*, the hoop 4 is fastened on the board 3 so as not to interact with the subplate 40 when said board is rotated. For this purpose, the hoop 4 comprises a support 53 which is fastened on the board 3 mechanically independent of the subplate 40.

Advantageously, the hoop 4 has an extension 4*a* which is rotatably mounted around an axis 54 secured to its support 53 for fastening to the board 3, so that said hoop could be stowed from its horizontal use position towards a vertical storage position against the board 3, in order to limit the bulk of said hoop in the storage configuration of the equipment.

For this purpose, the support 53 has two vertical sidewalls 53*a* which extend from a front face of the board 3 according to a sagittal direction, the extension 4*a* being rotatably mounted on a frontal axis 54 fastened between said sidewalls.

In particular, in the represented embodiment, the support 53 also comprises:

- a bottom 53*b* extending frontally at the rear of its vertical sidewalls 53*b*, and fastened to the board 3 by means of screws; and
- a second frontal axis 55 fastened between its vertical sidewalls 53*b*, on which the extension 4*a* of the hoop 4 abuts when said hoop is disposed in the use position.

What is claimed is:

1. Equipment for playing basketball, comprising a base, and a post having an upper post section and a lower post section, the upper post section having an upper segment and a lower segment, the upper segment being movably mounted relative to the lower segment, the upper segment having an upper end and carrying a board having a back face and a front face on which a hoop is mounted, the lower post section is rotatably mounted on the base configured to be movable between a stowed storage configuration against the base in a horizontal plane substantially parallel to the horizontal plane of the base and an upright use configuration in a vertical plane substantially perpendicular to the horizontal plane of the base, the board is mounted on the upper end of the upper segment through a rotational mechanism rotatable between an angular use position and an angular storage position, the rotational mechanism has a subplate, a friction insert, a rear cup fixed to the rear face of the board and a front cup and is connected at the upper end of the upper segment and the subplate is attached to the board back face, the subplate comprises an extension with a U-like shaped structure with two branches that join together at the upper end of the upper segment, the base of the U-like shape structure being forcibly fitted into the rotational mechanism by being clamped against the board back face with the friction insert interposed between the subplate and the board, the extension being disposed between the rear and front cups which are equipped with clamping adjusters for the extension therebetween, at least one of the front or rear cups housing the friction insert, the use position of the board being delimited by the abutment of the subplate on a stop member secured to the board.

2. The equipment according to claim 1, wherein, in the use position, the subplate is disposed above the upper post section.

3. The equipment according to claim 1, wherein a clamping adjuster is configured to adjust a friction torque of the rotation of the rotational mechanism.

4. The equipment according to claim 1, wherein the friction insert comprises a friction bushing which is clamped on a face of the extension through a clamping bushing of the cup.

5. The equipment according to claim 1, wherein the stop member of the board comprises a latch for locking the board in the use position.

6. The equipment according to claim 5, wherein the latch reversibly fits on an axis secured to the subplate.

7. The equipment according to claim 1, wherein the hoop is fastened on the board mechanically independent of the subplate.

8. The equipment according to claim 1, wherein the upper post section is slidably mounted on the lower post section, an actuation system for actuating the post between a retracted storage position and at least one projecting position corresponding to a height of use, the actuation system having a case fastened on a rear wall of the lower post section and a mechanism for moving the upper post section which is housed in the case, said mechanism comprising a handling socket which projects from the case.

9. The equipment according to claim 1, wherein the lower segment of the upper post section is slidably mounted on the lower post section, the upper segment of the upper post section being rotatably mounted on the lower segment between an angular upright use configuration and an angular folded storage configuration against the lower segment.

10. The equipment according to claim 1, wherein the board has a quadrilateral geometry with a top edge and a bottom edge, and the rotational mechanism is configured to allow the board to be rotated 90° from a first angular use position in a plane parallel to the vertical plane of the post with the top edge and bottom edge of the board being perpendicular to the direction of the upper post section to a second angular storage position with the top edge and bottom edge of the board being parallel to the direction of the upper post section.

11. The equipment according to claim 1, wherein the hoop has a lateral extension which is rotatably mounted around an axis secured to a support fastened on the board configured to permit the hoop to be stowed from a horizontal use position into a vertical storage position against the board.

12. The equipment according to claim 1, wherein the clamping adjuster passes through the front cup, a first friction insert, the extension, a second friction insert and the rear cup.

13. The equipment according to claim 12, wherein the first friction insert comprises a first friction bushing which is clamped on a first face of the extension through a clamping bushing of the front cup and the second friction insert comprises a second friction bushing which is clamped on a second face of the extension through the clamping bushing of the rear cup.

* * * * *